US009561920B1

(12) United States Patent
Wilsher et al.

(10) Patent No.: US 9,561,920 B1
(45) Date of Patent: Feb. 7, 2017

(54) MEDIA SUPPLY TRAY HAVING MULTI-COLOR EXTERIOR LIGHT INDICATING DIFFERENT MEDIA LOADING CONDITIONS

(71) Applicant: Xerox Corporation, Norwalk, CT (US)

(72) Inventors: Michael J. Wilsher, Letchworth (GB); Sebastian R. de Echaniz, Milton Keynes (GB); Paul S. Golding, Hertford (GB); Benjamin T. Thurnell, Cheshunt (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/872,211

(22) Filed: Oct. 1, 2015

(51) Int. Cl.
*B65H 1/00* (2006.01)
*B65H 1/26* (2006.01)
*B65H 1/04* (2006.01)

(52) U.S. Cl.
CPC ..... *B65H 1/266* (2013.01); *B65H 1/04* (2013.01); *B65H 2220/00* (2013.01); *B65H 2220/01* (2013.01); *B65H 2220/02* (2013.01); *B65H 2515/60* (2013.01)

(58) Field of Classification Search
CPC ..... B65H 2515/60; B65H 2220/00; B65H 2220/01; B65H 2220/02
See application file for complete search history.

(56) References Cited

U.S. PATENT DOCUMENTS 4,809,141 A 2/1989 Leopoldi et al.
5,157,448 A 10/1992 Lang
5,216,472 A 6/1993 Muto et al.
5,236,348 A 8/1993 Fetherolf et al.
5,539,512 A 7/1996 Mui
5,584,477 A 12/1996 Sakai
5,676,370 A 10/1997 Taniguchi et al.
5,884,132 A * 3/1999 Gotham ..... G03G 15/6502 271/145
5,975,515 A 11/1999 Capri et al.
2007/0104496 A1 5/2007 Penke et al.
2008/0187328 A1 8/2008 Schoedinger et al.
2011/0211893 A1* 9/2011 Shishido ..... B41J 3/60 400/76

FOREIGN PATENT DOCUMENTS

EP 0923003 A3 7/2000

* cited by examiner

*Primary Examiner* — Howard Sanders
(74) *Attorney, Agent, or Firm* — Gibb & Riley, LLC

(57) ABSTRACT

Printing devices include (and printing methods use) among other components, a processor, a printing engine operatively connected to the processor, a media supply tray operatively connected to the processor, etc. The media supply tray supplies sheets of media to the printing engine. The media supply tray has a light visible from the exterior of the printer. The processor controls the light to display different colors indicating different media loading conditions of the media supply tray. The different loading conditions can include a tray in use condition (indicated by the light displaying a first color); tray scheduled for use condition (indicated by the light displaying a second color); tray not in use condition (indicated by the light displaying a third color); tray empty condition, indicated by the light displaying a fourth color; etc.

20 Claims, 4 Drawing Sheets

MEDIA SUPPLY TRAY HAVING MULTI-COLOR EXTERIOR LIGHT INDICATING DIFFERENT MEDIA LOADING CONDITIONS

BACKGROUND

Devices herein generally relate to printer and media supply trays (paper supply trays) and more particularly to media supply trays having an exterior light.

When printing a large job, the printer often runs out of paper. Many printing devices use a main tray until empty, and then automatically switch to one or more compatible trays to keep printing non-stop. Thus, there often arises a need to fill media trays with media while other trays are being actively used; however it may not always be clear which trays are in use. Pulling out a paper tray when in use is often problematic and may jam paper inside the printing device and/or cause the job to stop.

SUMMARY

Printing devices herein include (among other components) a processor, a printing engine operatively (meaning directly or indirectly) connected to the processor, a media supply tray operatively connected to the processor, etc. The media supply tray supplies sheets of media to the printing engine. The media supply tray has a light (e.g., multi-color light emitting diode (LED) or other light producing device) visible from the exterior of the printer More specifically, the light is positioned on the media supply tray to be visible from the exterior of the printer when the media supply tray is fully inserted in the printer and is in position to supply the sheets of media to the printing engine of the printer.

The processor controls the light to display different colors indicating different media loading conditions of the media supply tray The different loading conditions can include a tray in use condition (indicated by the light displaying a first color); tray scheduled for use condition (indicated by the light displaying a second color); tray not in use condition (indicated by the light displaying a third color); tray empty condition, indicated by the light displaying a fourth color; etc. The colors are all visibly different from one another (and one of the colors can simply be that the light is off).

The "tray in use" loading condition occurs when sheets are being actively supplied from the media supply tray. The "tray scheduled for use" loading condition occurs when sheets are to be actively supplied from the media supply tray for an upcoming printing action. The "tray not in use" loading condition occurs when sheets are not to be actively supplied from the media supply tray for any currently pending printing action. The "tray empty" loading condition occurs when no sheets are in the media supply tray.

The printer can also include a tray lock operatively connected to the processor. The processor controls the tray lock to prevent the media supply tray from being opened when the first color is displayed by the light (indicating that the tray in use loading condition and the media supply tray should not be opened) and when the second color is displayed by the light (indicating the tray scheduled for use loading condition and the media supply tray should not be opened).

Additionally, the processor can control the light to flash when displaying some of the different colors, without flashing the light (e.g., displaying a solid light) when displaying others colors.

Presented in method form, methods herein supply sheets of media from a media supply tray to internal components of a printer. The media supply tray has a light visible from the exterior of the printer. Such methods display different colors using the light (e.g., multi-color light emitting diode, etc). The different colors (some of which can be flashing colors) indicate different media loading conditions of the media supply tray. The different loading conditions can include a tray in use condition, indicated by the light displaying a first color; a tray scheduled for use condition, indicated by the light displaying a second color; a tray not in use condition, indicated by the light displaying a third color; a tray empty condition, indicated by the light displaying a fourth color; etc., where such colors are different from one another. Also, one of the colors can be where the light is off.

The printer may further include a tray lock, and the method then can prevent the media supply tray from being opened using the tray lock when the first color is displayed by the light (indicating that the tray in use loading condition is present and the media supply tray should not be opened) and when the second color is displayed by the light (indicating that the tray scheduled for use loading condition is present and that the media supply tray should not be opened).

These and other features are described in, or are apparent from. The following detailed description.

BRIEF DESCRIPTION OF THE DRAWINGS

Various exemplary devices are described in detail below, with reference to the attached drawing figures, in which.

DETAILED DESCRIPTION

As mentioned above, there often arises a need to fill media trays with media while other trays are being actively used; however it may not always be clear which trays are in use, and pulling out a paper tray when in use is often problematic and may jam paper inside the printing device and/or stop the job.

In view of this, devices described herein provide a user-friendly indicator light incorporated on the tray or (to reduce the complexity of implementation) by the side of the tray. This light indicates whether that tray is in use and is not available for refilling. Further, such an indictor light indicates (using different colors) whether the tray in use, scheduled for use, empty, or is available to be filled from the machine controller. By relying upon the indictor light color, the user can confidently fill a free compatible tray (by supplying print media into a tray that is not in use) without fear of disturbing a tray being actively used. The printing device can then switch to the recently filled tray, and subsequent compatible refilled trays, as other trays empty, to maintain non-stop printing. Hence, it is possible to periodically fill all the trays and maintain a long print run without the machine pausing or causing jams.

In a specific implementation, these devices can include a multi-color light (e.g., tri-color light emitting diode (LED)) that indicates multiple states. Such different states and colors can be, but are not limited to: in use (red light); scheduled in queue (orange light); empty tray (green light); unused and can be filled (unlit); etc.

Any form of implementation can be used for the multi-color indicator light. For example, the light can comprise one or more lights, and can be on the tray or next to the tray on the printer body. Also, a frosted clip in window on the front of the tray and lights fitted on the frame are useful implementations. In one example, a plastic light guide (e.g., optical fiber) can be positioned between the light and the tray front and, if provided a sufficient collection area adjacent the frame-mounted light, such an arrangement can be insensitive to alignment of the tray and the frame-mounted light. With lights that are mounted on the frame or next to the tray on the printer body, no contacts or tray wiring is required, simplifying manufacture and reducing costs.

Figure 1:
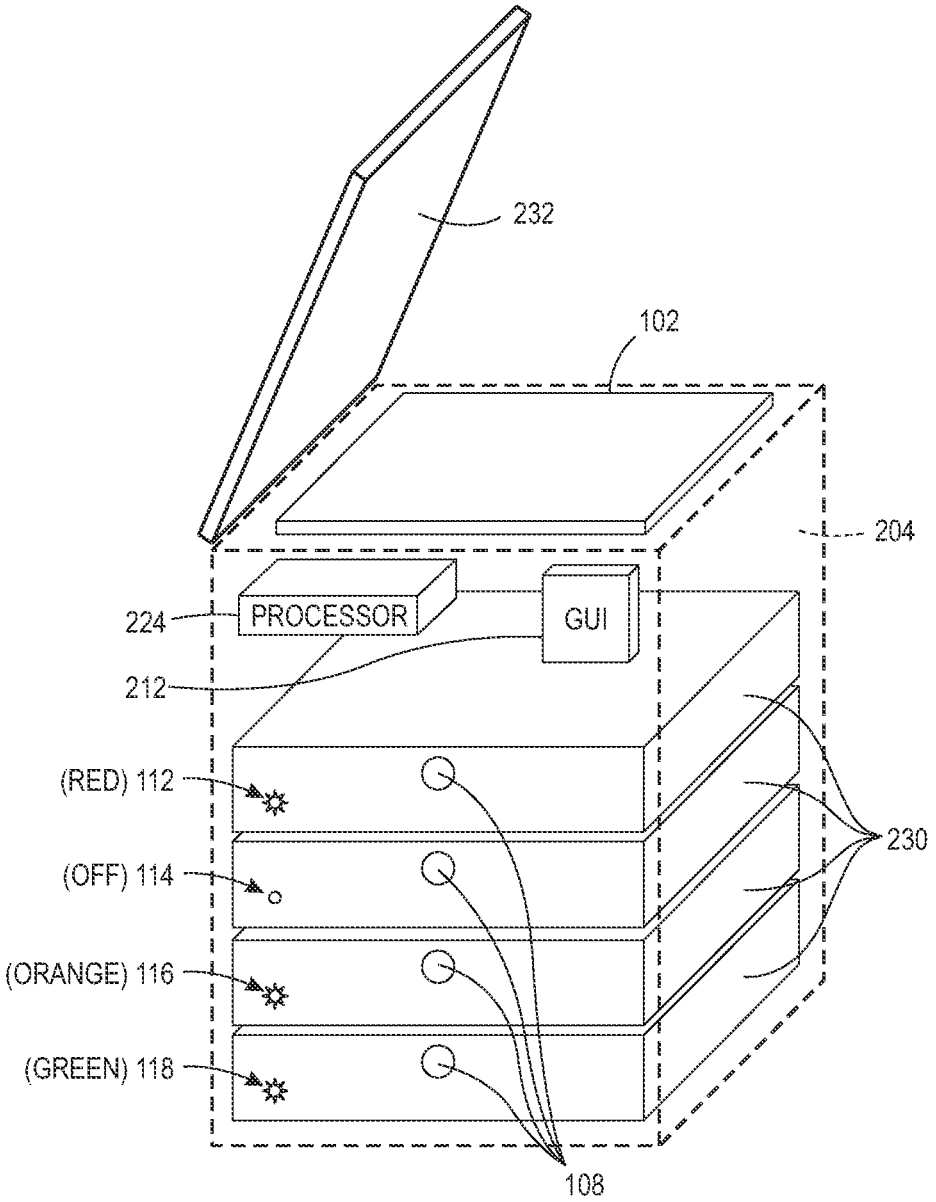
FIG. 1 is a schematic diagram illustrating devices herein.

Referring now to the drawings, as shown in FIG. 1, a processor 224 of a printing device 204 having a platen 102 (also shown in FIG. 3, and discussed in greater detail below) controls lights (items, 112, 114, 116, and 118) on, or adjacent to, media trays 230 to display different colors indicating different media loading conditions of the media supply trays 230.

The devices 204 herein can use any form of lighting devices for lights 112, 114, 116, and 118 (e.g., incandescent, laser, light emitting diode, etc.) that have the ability to produce different colors (and possibly to flash on and off). For example, any form of single multi-color light element could be utilized, or an assembly of different color lighting elements combined into a single packaging item could be utilized. In addition, such a multi-color light element 112, 114, 116, and 118 can be positioned on the exterior of the tray 230, on the exterior of the printing device 204 adjacent the trays 230, or any location that is visible from the exterior of the printing device 204. For example, the media trays 230 may include a transparent or translucent portion, and the multi-color light elements 112, 114, 116, and 118 may be positioned to be visible through the transparent or translucent portion. While some specific lighting elements and positions are discussed herein, those ordinarily skilled in the art would understand that any arrangement that allows different colors to be viewed from the exterior of the media tray 230 are useful with devices herein.

In one example, the different loading conditions can include a tray in use condition, indicated by one of the lights 112 displaying a first color (e.g., red); tray not in use condition, indicated by one of the lights 114 being unlit (e.g., black); tray scheduled for use condition, indicated by one of the lights 116 displaying a second color (e.g., orange); tray empty condition, indicated by one of the lights 118 displaying a third color (e.g., green)); etc. Also, the different colors (potentially blinking) displayed by the lights 112 can further indicate different faults that the tray may experience, such as mis-feeds, paper jams, or other error conditions. The colors are all visibly different from one another, and for ease of discussion, one of the "colors" (e.g., black) that can be displayed herein is simply a display condition where the light is off. Additionally, the processor 224 can control the light to flash when displaying some of the different colors, or to remain on without flashing (e.g., a solid, continuous, non-flashing light) when displaying others colors.

The "tray in use" loading condition occurs when sheets are being actively supplied from the media supply tray 112, and is a condition where the tray should not be opened because opening the tray in this condition will cause printing to stop and may cause a paper jam or other damage. The "tray scheduled for use" loading condition occurs when sheets are soon to be actively supplied from the media supply tray for an upcoming printing action 116, and may be a condition where the tray should not be opened, depending upon how soon the upcoming printing action will occur (in terms of time or number of print jobs). The "tray not in use" loading condition occurs when sheets may be in the media tray, but are not to be actively supplied from the media supply tray for any currently pending printing action, and the tray can be opened without detrimental consequence. The "tray empty" loading condition occurs when no sheets are in the media supply tray 118, and the tray can similarly be opened without detrimental consequence.

The printer 224 can optionally include tray locks 108 operatively connected to the processor 224 and the media trays 230. The processor 224 can control the tray locks 108 to prevent the media supply trays 230 from being opened when the red color is displayed by the lights 112, 114, 116, 118 (indicating that the tray in use loading condition is present, and that the media supply tray should not be opened), for example, and/or when the orange color is displayed by the lights 112, 114, 116, 118 (indicating that the tray scheduled for use loading condition is present, and that the media supply tray should not be opened). When other colors (e.g., green, white, black) are displayed, the locks 108 can remain unlocked, allowing the media trays 230 to be opened by the user. In other words, with devices herein, the operation of the locks 108 can be coordinated with the color that is displayed by the lights 112, 114, 116, 118 by the processor.

Figure 2:
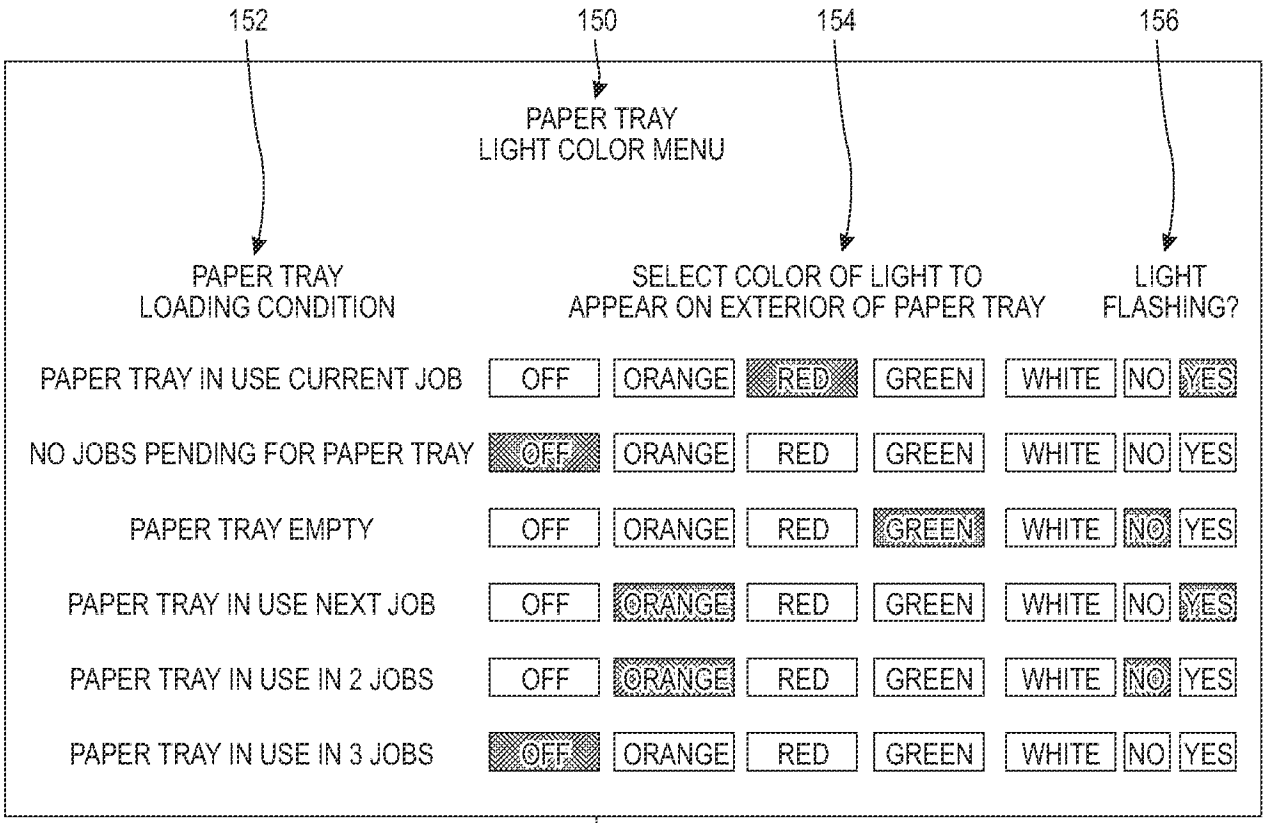
FIG. 2 is a schematic diagram illustrating menus provided by devices herein.

FIG. 2 is a schematic diagram illustrating exemplary paper tray light color menus 150 that can be provided on the user interface 212 of the printer 204. As would be understood by those ordinarily skilled in the art, such menus 150 could include more menu options or less menu options, and FIG. 2 is merely one of many examples that could be utilized by devices herein. As shown in FIG. 2, a user can select from among different colors (off (or black), orange, red, green, white, etc.) by selecting various radio buttons 154 for different paper tray loading conditions 152; and the user can select whether the light should flash by selecting from various radio buttons 156.

While "radio buttons" are used in the foregoing example, any menu selection feature provided by the graphic user interface 212 can be used, such a touchscreen buttons, hard (physical) buttons, selections with a clickable pointing device (mouse, stylist, etc.), voice commands, etc., by device herein depending upon the capabilities of the graphic user interface 212.

Note that the exemplary menu 150 shown in FIG. 2 allows different colors to be displayed through the light depending upon how soon a given media tray is expected to be utilized. Specifically, this is shown were different colors can be displayed depending upon whether the media tray will be used in the very next print job, will be used in 2 print jobs, will be used in 3 print jobs, etc. While the timing of when the media tray is next to be used is presented on the menu 150 in terms of the number of print job, the menu could also display time in seconds, minutes, hours, etc. Therefore, the individual choosing the various settings through the paper tray light control menu 150 can estimate how long it may take an individual to reload a specific tray (in terms of print jobs or time, etc.) and can make the light on the exterior of the media tray illuminate a different color based upon whether the user will be able to complete the paper reloading operation before media is expected to be drawn out of the media tray.

In the example shown in FIG. 2, the menu options that have been selected will cause an orange light to flash if the paper tray is expected to be used on the very next print job, a steady (continuous) orange light to be displayed if the paper tray is expected to be used in 2 print jobs, and for the light to be off (or black) if the paper tray is expected to be used in 3 (or more) print jobs in the future. Such a lighting pattern would provide a flashing orange light to discourage a user from opening a media tray that will be used for the very next print job, provide a continuous orange light to cause a user to be very cautious about opening a media tray that will be used in 2 print jobs, and provide no light to indicate that a user can proceed with opening the media tray with confidence that the media tray is not expected to be used soon (e.g., not for 3 (or more) print jobs that will occur in the future).

Figure 3:
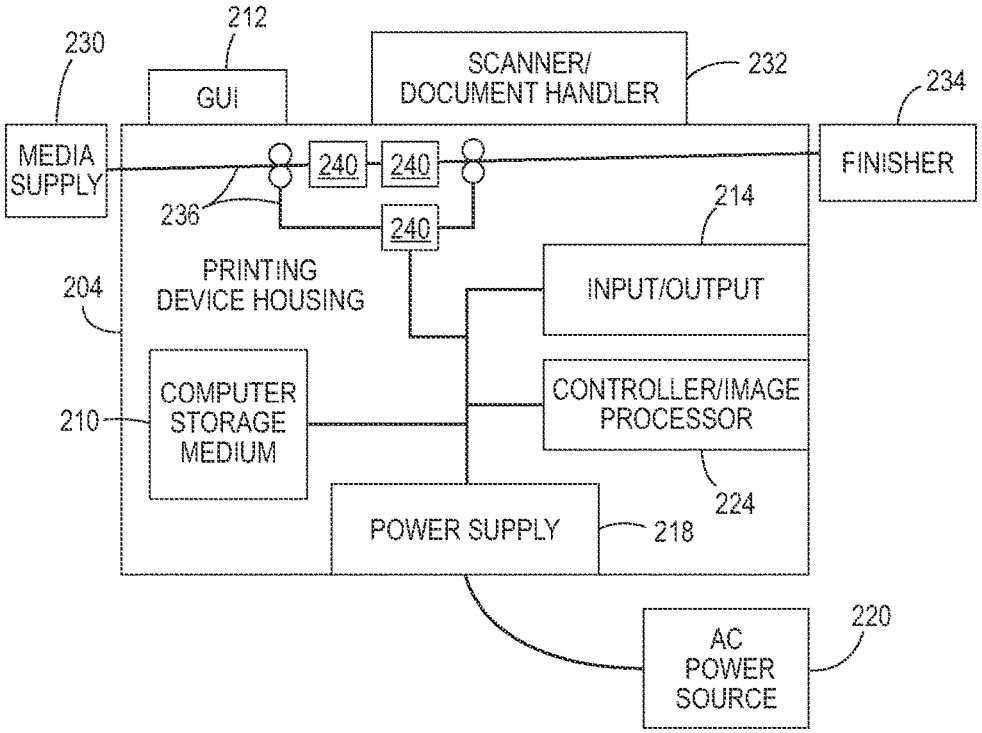
FIG. 3 is a schematic diagram illustrating devices herein.

FIG. 3 illustrates a printing device 204, which can be used with devices herein and can comprise, for example, a printer, copier, multi-function machine, multi-function device (MFD), etc. The printing device 204 includes a controller/tangible processor 224 and a communications port (input/output) 214 operatively connected to the tangible processor 224 and to the computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently pending or developed in the future). The tangible processor 224 controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 3, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes many of the components mentioned above and at least one marking device (printing engine(s)) 240 operatively connected to a specialized image processor 224 (that is different than a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies a marking material (toner, inks, etc.) to continuous media or sheets of media, whether currently pending or developed in the future and can include, for example, devices that use a photoreceptor belt or an intermediate transfer belt, or devices that print directly to print media (e.g., inkjet printers, ribbon-based contact printers, etc.).

As would be understood by those ordinarily skilled in the art, the printing device 204 shown in FIG. 3 is only one example and the devices herein are equally applicable to other types of printing devices that may include fewer components or more components. For example, while a limited number of printing engines and paper paths are illustrated in FIG. 3, those ordinarily skilled in the art would understand that many more paper paths and additional printing engines could be included within any printing device used with devices herein.

Figure 4:
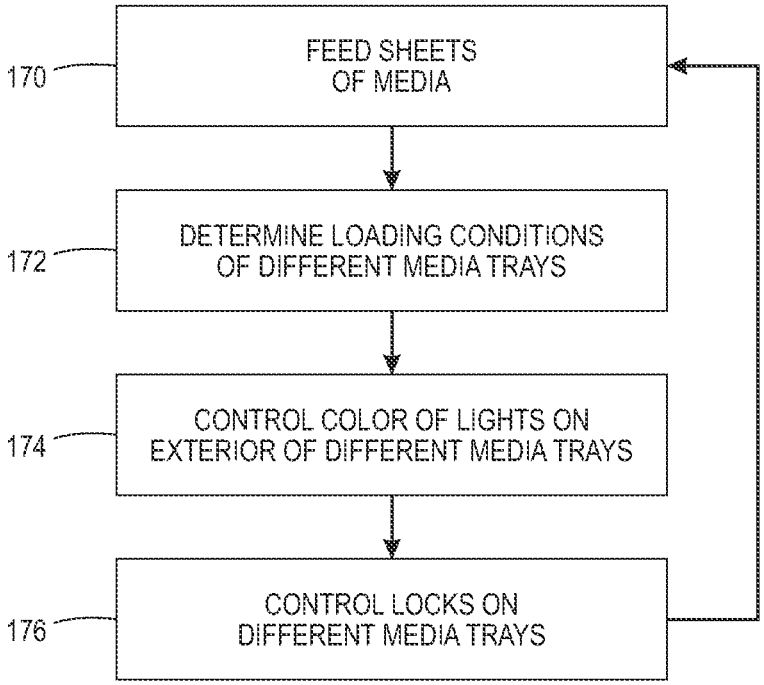
FIG. 4 is a flow diagram of various methods herein.

Thus, presented in method form in the flowchart in FIG. 4, methods herein supply sheets of media (170) from a media supply tray 230 to internal components of a printer 240. In item 172, the printing device determines the loading conditions of the different media trays by determining whether the trays contain print media, whether the trays are actively being used or will shortly be used, etc.

The media supply trays 230 have lights visible from the exterior of the printer 204. Such methods display different colors using the light (e.g., multi-color light emitting diode, etc). The different colors (some of which can be flashing colors) indicate different media loading conditions of the media supply tray 230. Thus, as shown in item 174, the processor of the printer controls the color of the lights on the exterior of the different media trays to display different colors based upon the different loading conditions of the different media trays. Again, the different loading conditions can include a "tray in use" condition, indicated by the light displaying a first color; a "tray scheduled for use" condition, indicated by the light displaying a second color; a "tray not in use" condition, indicated by the light displaying a third color; a "tray empty" condition, indicated by the light displaying a fourth color; etc., where such colors are different from one another.

As noted above, the printer may further include tray locks 108. Thus, the method then can prevent one or more of the media supply trays 230 from being opened using the tray locks 108 based upon the loading conditions of the different media trays, as shown in item 176. As shown by the arrow returning from item 176 to item 170, this process is continually applied to the media trays by the processor of the printing device.

Therefore, as shown above, the devices herein provide lighting elements 112, 114, 116, and 118 capable of displaying different colors (dependent upon the current loading conditions) on media trays 230, where the different colors (and the potential flashing nature) of the lighting elements 112, 114, 116, and 118 allows the user to easily and intuitively know whether the user can safely open one or more of the media trays 230. If a predetermined color (e.g., red, orange, etc.) were displayed on the exterior surface of the media trays 230, the user would be disinclined from pulling the media tray 230 out from the body of the printing device 204 to open the media tray; while a different color displayed on the exterior surface of the media trays 230 (e.g., white, black, green, etc.) would provide the user with confidence that they could open a door or drawer to open the media tray without causing paper jams or the printing operation to stop.

As noted above, each different light 112, 114, 116, and 118 on each different tray 230 may be a different color (and may or may not be flashing) at different times depending upon whether there is paper in the tray, whether the printing device 204 is actively removing sheets of media from the media tray 230, whether the printing device 204 will be attempting to draw sheets from the media tray 230 in a very short time (for the next upcoming job), etc. By providing different colors on different trays at different times (based upon different loading and usage conditions of the different trays) the devices herein provide a quick and easy indicator to allow the user to safely load additional paper into certain media trays 230, even while the printing device continues to print and draw media from other media trays 230, so as to continue printing non-stop and without interruption. In addition, the foregoing can be combined with various locking systems to further prevent inappropriate opening of the media trays 230, and thereby prevent paper jams or stoppage of printing.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the devices described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The devices herein can encompass devices that print in color, monochrome, or handle color or monochrome image data. All foregoing devices are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices herein cannot be implied or imported from any above example as limitations to any particular order, number, position, size, shape, angle, color, or material.

What is claimed is:

1. A printer comprising:

a media supply tray supplying sheets of media to internal components of said printer, said media supply tray having a light visible from an exterior of said printer, said light displaying different colors indicating different media loading conditions of said media supply tray, said different media loading conditions comprising:

tray in use condition, indicated by said light displaying a first color;

tray scheduled for use condition, indicated by said light displaying a second color;

tray not in use condition, indicated by said light displaying a third color; and tray empty condition, indicated by said light displaying a fourth color, said first color, said second color, said third color, and said fourth color being different from one another.

2. The printer according to claim 1, said light being positioned to be visible from an exterior of said printer when said media supply tray is fully inserted in said printer and in position to supply said sheets of media to said internal components of said printer.

3. The printer according to claim 1, an additional media loading condition of said different media loading conditions being indicated by said light being off.

4. The printer according to claim 1, said light comprising a multi-color light emitting diode.

5. The printer according to claim 1, further comprising a tray lock, said tray lock preventing said media supply tray from being opened when:

said first color is displayed by said light indicating said tray in use condition; and said second color is displayed by said light indicating said tray scheduled for use condition.

6. The printer according to claim 1, said light flashing when displaying one of said different colors, and said light not flashing when displaying others of said different colors.

7. The printer according to claim 1, said tray in use condition comprising sheets being actively supplied from said media supply tray, said tray scheduled for use condition comprising sheets to be actively supplied from said media supply tray for an upcoming printing action, said tray not in use condition comprising sheets not to be actively supplied from said media supply tray for any currently pending printing action, and said tray empty condition comprising no sheets being in said media supply tray.

8. A printer comprising:

a processor, a printing engine operatively connected to said processor; and a media supply tray operatively connected to said processor, said media supply tray supplying sheets of media to said printing engine, said media supply tray having a light visible from an exterior of said printer, said processor controlling said light to display different colors indicating different media loading conditions of said media supply tray, said different media loading conditions comprising:

tray in use condition, indicated by said light displaying a first color;

tray scheduled for use condition, indicated by said light displaying a second color;

tray not in use condition, indicated by said light displaying a third color; and tray empty condition, indicated by said light displaying a fourth color, said first color, said second color, said third color, and said fourth color being different from one another.

9. The printer according to claim 8, said light being positioned to be visible from an exterior of said printer when said media supply tray is fully inserted in said printer and in position to supply said sheets of media to said printing engine of said printer.

10. The printer according to claim 8, an additional media loading condition of said different media loading conditions being indicated by said light being off.

11. The printer according to claim 8, said light comprising a multi-color light emitting diode.

12. The printer according to claim 8, further comprising a tray lock operatively connected to said processor, said processor controlling said tray lock to prevent said media supply tray from being opened when:

said first color is displayed by said light indicating said tray in use condition; and said second color is displayed by said light indicating said tray scheduled for use condition.

13. The printer according to claim 8, said processor controlling said light to flash when displaying one of said different colors, and said light to not flash when displaying others of said different colors.

14. The printer according to claim 8, said tray in use condition comprising sheets being actively supplied from said media supply tray, said tray scheduled for use condition comprising sheets to be actively supplied from said media supply tray for an upcoming printing action, said tray not in use condition comprising sheets not to be actively supplied from said media supply tray for any currently pending printing action, and said tray empty condition comprising no sheets being in said media supply tray.

15. A method comprising:

supplying sheets of media from a media supply tray to internal components of a printer, said media supply tray having a light visible from an exterior of said printer; and displaying different colors using said light, said different colors indicating different media loading conditions of said media supply tray, said different media loading conditions comprising:

tray in use condition, indicated by said light displaying a first color;

tray scheduled for use condition, indicated by said light displaying a second color;

tray not in use condition, indicated by said light displaying a third color; and tray empty condition, indicated by said light displaying a fourth color, said first color, said second color, said third color, and said fourth color being different from one another.

16. The method according to claim 15, said light being positioned to be visible from an exterior of said printer when said media supply tray is fully inserted in said method and in position to supply said sheets of media to said internal components of said method.

17. The method according to claim 15, an additional media loading condition of said different media loading conditions being indicated by said light being off.

18. The method according to claim 15, said light comprising a multi-color light emitting diode.

19. The method according to claim 15, said printer further comprising a tray lock, said method further comprising preventing said media supply tray from being opened using said tray lock when:

said first color is displayed by said light indicating said tray in use condition; and said second color is displayed by said light indicating said tray scheduled for use condition.

20. The method according to claim 15, said displaying different colors comprising said light flashing when displaying one of said different colors, and said light not flashing when displaying others of said different colors.

* * * * *